United States Patent [19]

Termohlen

[11] 3,958,113

[45] May 18, 1976

[54] LIGHTING EFFECTS DEVICE

[76] Inventor: Carol I. Termohlen, 217 16th St., Apt. No. 1, Huntington Beach, Calif. 92648

[22] Filed: Aug. 12, 1974

[21] Appl. No.: 496,735

Related U.S. Application Data

[63] Continuation-in-part of Ser. No. 354,825, April 26, 1973, abandoned.

[52] U.S. Cl. ..... 240/1 EL; 240/10 R; 84/464; 84/267

[51] Int. Cl.[2] ..... A47G 33/16; F21P 1/02

[58] Field of Search ..... 240/1 EL, 8.16, 10 R, 240/21; 84/464

[56] References Cited

UNITED STATES PATENTS

| | | | |
|---|---|---|---|
| 2,561,885 | 7/1951 | Prideaux et al. | 240/1 EL X |
| 2,594,081 | 4/1952 | Shlenker | 240/1 EL |
| 3,154,251 | 10/1964 | Dupree et al. | 240/8.16 |
| 3,246,133 | 4/1966 | Hensleigh | 240/1 EL X |
| 3,324,755 | 6/1967 | Canonico | 84/267 |
| 3,413,458 | 11/1968 | Barefoot | 240/10 R |
| 3,491,245 | 1/1970 | Hardesty | 240/1 EL X |
| 3,809,877 | 5/1974 | Kwong | 240/1 EL |
| 3,816,739 | 6/1974 | Stolov | 240/10 R |

*Primary Examiner*—Richard M. Sheer
*Attorney, Agent, or Firm*—John H. Crowe; Peter H. Firsht

[57] ABSTRACT

Solid transparent plastic material has frosted surfaces and contains lights the rays of which are diffused by the surfaces and viewed as a solid field of luminous light. Preferably, the lights are variously colored, for example, red, blue and green, and are energized by suitable switching means to produce color fields in each of the colors and in the pastel or sum colors thereof. This color field effect is incorporated in a plastic guitar, energization of the lights therein being responsive to tone frequencies as the guitar is played, to provide a spectacular display of light and whereby the guitar player sees his music in color fields that change hue.

10 Claims, 15 Drawing Figures

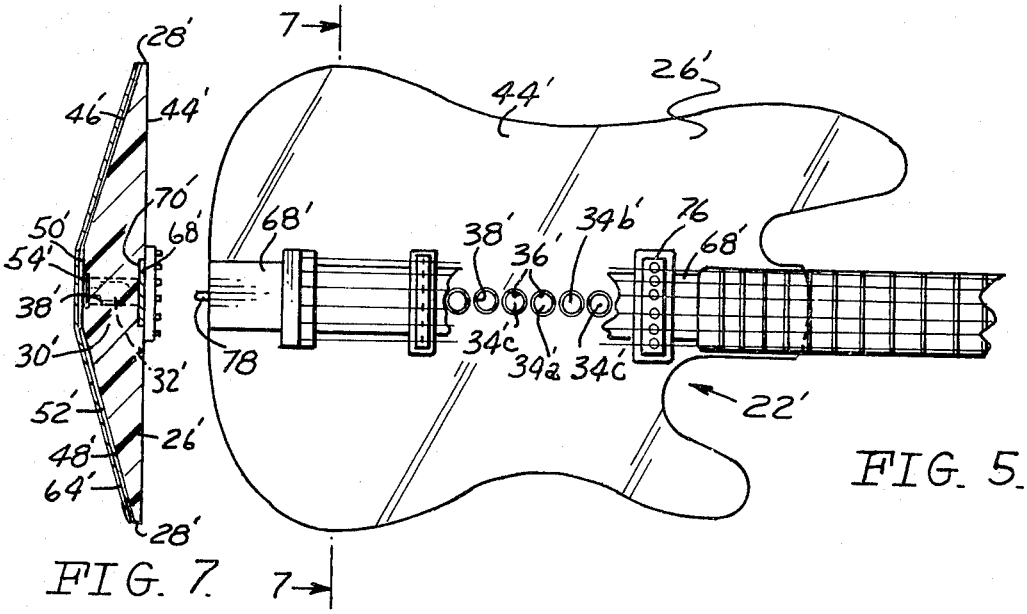
FIG. 5.
FIG. 7.
FIG. 6.
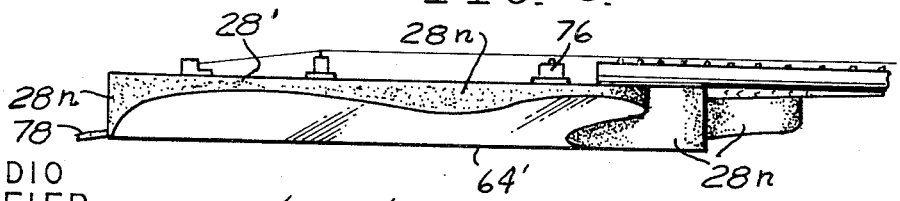
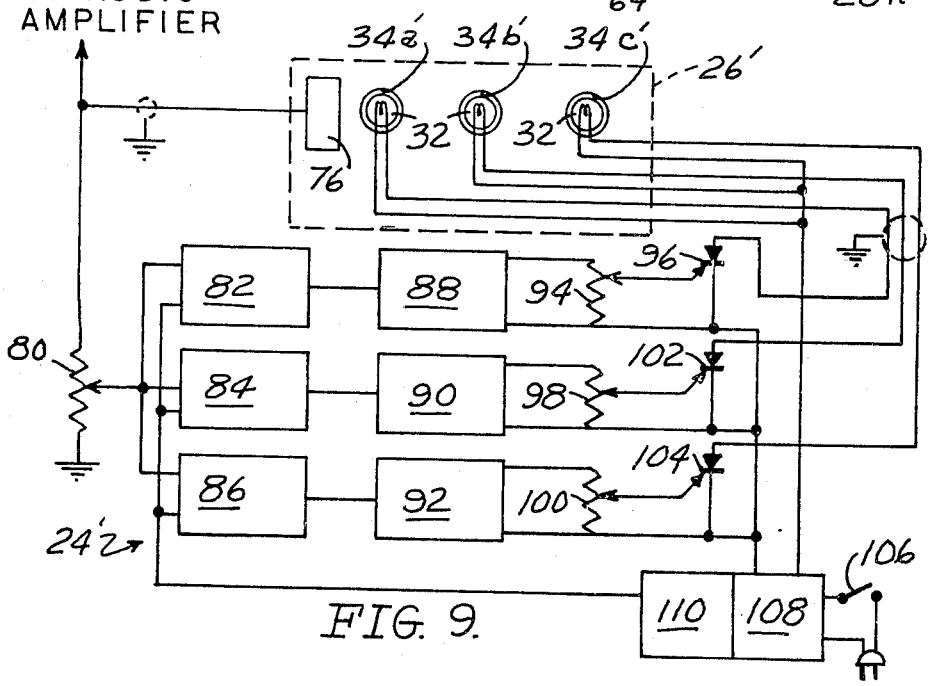
FIG. 9.
FIG. 4.
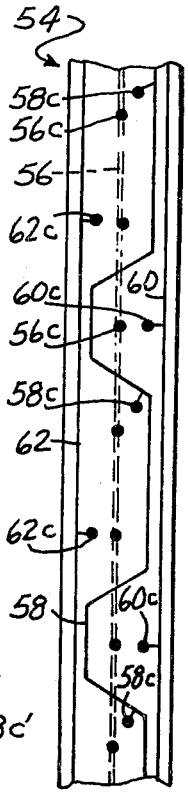
FIG. 8.
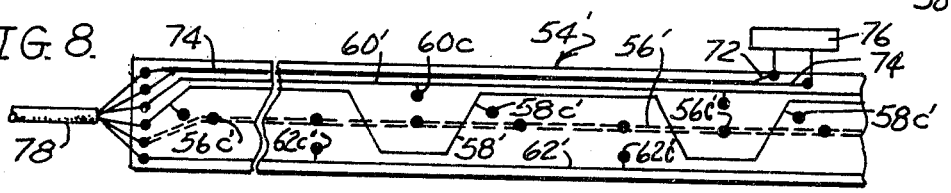

LIGHTING EFFECTS DEVICE

CROSS REFERENCE TO RELATED APPLICATIONS

This application is a continuation-in-part of my pending U.S. Pat. application Ser. No. 354,825, filed Apr. 26, 1973, now abandoned.

BACKGROUND OF THE INVENTION

The present invention relates to lighting devices which produce light in a variety of colors; and more particularly to a novel lighting effects device which produces a luminescing or glowing solid volume or field of uniform colored light that has a hue changing from basic colors, red, blue, or green, to the pastel or sum colors thereof.

The employment of colored light that flashes, flickers, or otherwise changes, generally referred to as psychedelics, is becoming more widespread in providing a pleasant backdrop or complementary appeal to the other senses. This is especially true in the field of musical entertainment, where musicians find their services are often more sought after if their musical artistry is combined with some other medium of appeal, such as a light show, which enhances their performance.

The present invention differs therefrom in that, instead of physchedelics, there is provided a light luminescing device which to the viewer appears to emit a solid volume of luminous light, and such luminescence is viewed in basic colors and the pastel or sum colors thereof.

SUMMARY OF THE INVENTION

It is therefore an object of the present invention to provide a lighting device which produces novel color light effects.

Another object is to provide a light luminescing device which appears to emit a solid volume or field of luminous light.

Still another object of the invention is to provide a musical instrument in which lights are associated with the instrument in a novel manner and produce colored light which luminesces or glows and changes with variations in the frequency of the tones emanating from the instrument.

A further object of the invention is to provide a guitar having a novel body and masked light emitting means for generating a solid volume or field of uniform colored light which glows and changes hue with variations in tone frequency as the guitar is played and presents a spectacular color effect which is beautiful and eye-appealing.

These and other objects and advantages of the present invention are achieved by the provision of a novel lighting effects device made from an elongated piece of transparent plastic material having a cross sectional shape that is substantially trapezoidal, with a water clear front viewing face and a backing including frosted surfaces, that trap and diffuse light, and a light absorbing shield, in the form of a piece of gray abrasive particle paper, that reduces external frontal light reflections and enhances light diffusion. Centrally of the plastic piece is a longitudinal row of lamps or light bulbs embedded or set firmly in perforations in the plastic material, each perforation having a frosted cylindrical wall within which is fitted a colored casing containing a lamp or light bulb. The casings are preferably of three basic colors — red, blue and green — and the lamps are adapted to be energized to produce any one of the basic colors or a combination thereof, the light from the lamps being diffused by the light-diffusing walls of the perforations and the backing, and is viewed through the clear front face as a luminescing or glowing solid volume or field of light of uniform color having a color depending upon the lamps that are energized and changing hue as different lamps are energized. In a special application of the invention, the piece of plastic material is part of a guitar and the lamps are energized in response to variations in tone frequency as the guitar is played, to produce glowing color fields in the basic colors and the pastel or sum colors thereof.

BRIEF DESCRIPTION OF THE DRAWINGS:

FIG. 4 is a fragmentary schematic view of a printed circuit board which is part of the light panel of FIG. 2.

FIG. 5 is a fragmentary plan view of an electrical guitar embodying the principles of the present invention with parts thereof broken away.

FIG. 6 is a side elevational view of the guitar of FIG. 5.

FIG. 7 is a vertical sectional view generally along line 7—7 of FIG. 5.

FIG. 8 is a fragmentary schematic view of a printed circuit board forming part of the guitar of FIG. 5.

FIG. 9 is a diagram schematically illustrating a frequency responsive switching means used with the guitar of FIG. 5.

Figure 2:
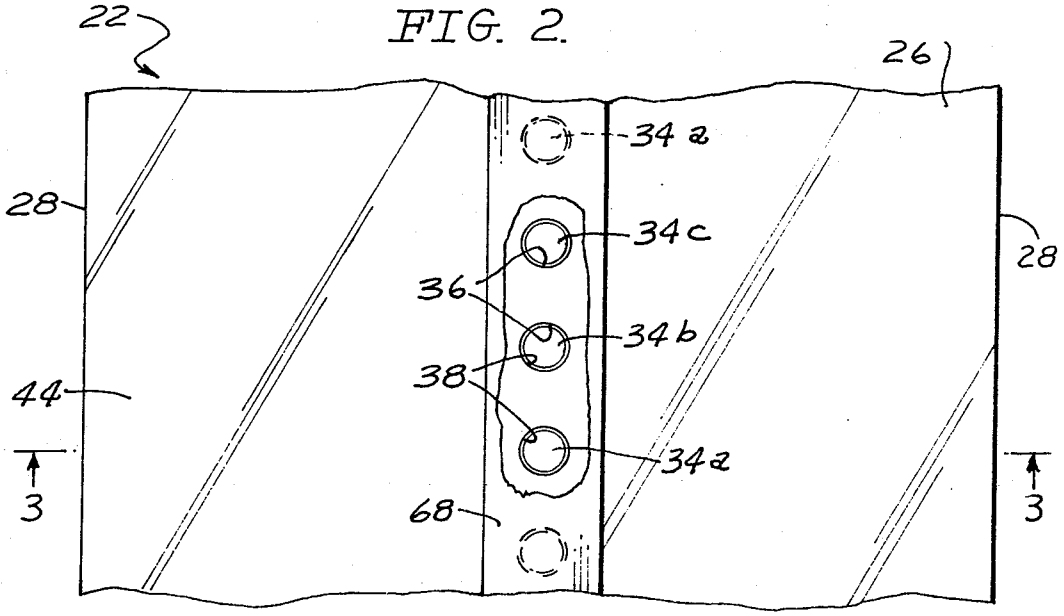
FIG. 2 is a fragmentary plan view of a light panel which is part of the device of FIG. 1, with parts thereof broken away.
Figure 1:
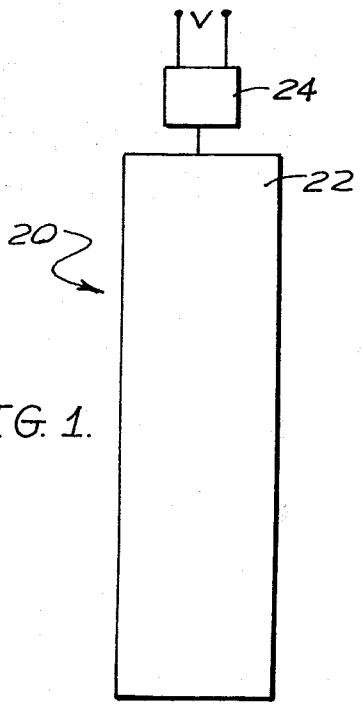
FIG. 1 is a schematic diagram illustrating a lighting effects device embodying the principles of the present invention.
Figure 3:
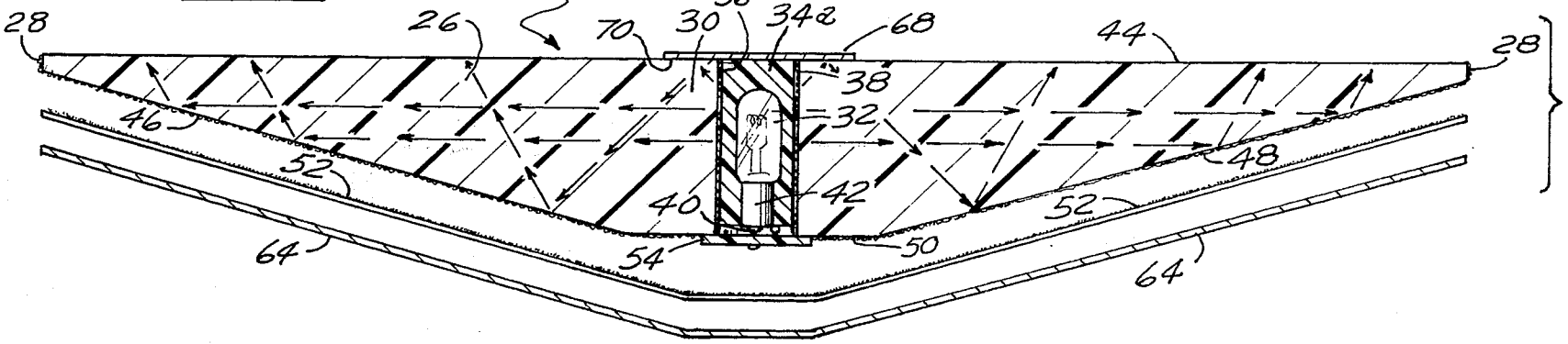
FIG. 3 is a larger scale partly exploded cross-sectional view generally along line 3—3 of FIG. 2.

DESCRIPTION OF THE PREFERRED EMBODIMENT:

Referring to FIG. 1, there is schematically illustrated a lighting effects device 20 embodying the principles of the present invention and including a light panel 22 connected through suitable switch means 24 to a suitable source of voltage power V, alternating or direct current. Inviting attention to FIGS. 2 and 3, the light panel 22 is formed from an elongated piece or body 26 of solid transparent plastic material and has relatively thin side edges 28 and a substantially trapezoidal cross-section, as shown in FIG. 3. The body varies in thickness from relatively thin at the side edges 28, to gradually thicker and thickest at the central portion 30. The edges 28 are exposed to view and are frosted to diffuse light.

Contained within the plastic material of the portion 30 there is a longitudinal row of lamps or light bulbs 32 which are embedded or set firmly therein by means of an individual colored casing around each light bulb. The casings are serially arranged in sets or banks of three, each of a different color, for example, red 34*a*, blue 34*b*, green 34*c*, see FIG. 2. The casings are closely fitted within a row of perforations 36 in the central portion and each perforation has a frosted cylindrical wall 38 which diffuses the light emitted from the light bulb therewithin, each light bulb having the usual central electrode 40 and jacket electrode 42, see FIG. 3.

The plastic material body 26 has a water-clear front face 44 and a backing including light diffusing frosted surfaces 46, 48 and 50, with surfaces 46 and 48 at an acute angle to the face 44, and surface 50 generally parallel thereto. The surfaces 46, 48 and 50 are backed by a light absorbing shield in the form of a piece of dark gray abrasive particle paper 52 shaped to the body and disposed with the particle side of the paper adjacent the surfaces. The shield serves to reduce external light reflections and enhance light diffusion.

Associated with the light bulbs 32 is a printed circuit board 54, schematically illustrated in FIG. 4, which has a circuit line or run 56 common to all of the light bulbs 32 and is provided with suitably spaced contacts 56c adapted to engage the central electrodes 40 of the bulbs. The board also has a circuit line or run 58 provided with contacts 58*c* engageable with the jacket electrodes 42 of the light bulbs in the casings 34*a*, a run 60 with contacts 60*c* for the bulbs in casings 34b and a run 62 with contacts 62*c* for the bulbs in casings 34c.

A protective back cover 64 protects the circuit board 54 and holds the paper 52 in place.

Overlying the casings 34*a–c* is an elongated masking strip 68 which hides the casings and the light bulbs therein from direct view. The strip has a bright underside 70. Thus, as shown in FIG. 3, light rays emitted from the light bulb 32 which impinge upon the reflector 70 are reflected toward the frosted back surfaces 46, 48 and 50, the color of the casing coloring the light and the frosted perforation wall 38 diffusing the same. The back surfaces further diffuse the light rays. The same applies to light rays proceeding laterally and downwardly from the light bulbs. The diffused light is viewed through the clear front face 44 as a glowing solid field or volume of luminous colored light. The paper light shield 52 enhances the diffusion and enlivens the color field.

The color of the color field depends upon the color of the light rays. When the light bulbs have been energized to emit light rays of only one of the three basic colors, red, blue or green, the color field will have that one color. That is, when the light bulbs in casings 34*a* are energized, the color field will be red; casings 34*b* blue; and casings 34*c* green. However, when the light bulbs are energized to produce light rays in two or three basic colors, the color field is the sum of the basic colors.

The switch means 24 can be of any suitable form to cause energization of the light bulbs for producing the basic colors individually or in combination.

It is believed that the operation of the lighting effects device is readily apparent and is briefly summarized at this point. With the lighting effects device 20 connected to a power source and the switch means 24 activated to energize the light bulbs in the casings 34*a*, red color light will be produced and impinge upon the light diffusing frosted surfaces 46, 48 and 50 and be seen through the water clear front face 44 as a glowing, solid field of uniform red color light. Activation of the switch means to energize the light bulbs in casing 34*b* produces blue color light and a glowing field or volume of blue color light. Energization of the light bulbs in casings 34*c* produces a glowing field of green color light. Energization of the light bulbs in casings 34*a* and 34*b* produces a color field in the sum color of the red and blue basic colors. Energization of the light bulbs in casings 34*a* and 34*c* produces a color field in the sum color of red and green; energization of the light bulbs in casings 34*b* and 34*c* produces a color field in the sum color of blue and green; and energization of the light bulbs in casings 34*a*, 34*b* and 34*c* produces a color field in the sum color of red, blue and green. Varying the switching varies the color fields which glow and change hue with such variations to produce luminous color fields in a variety of colors depending upon the light bulbs that are energized.

It is to be noted that the plastic body 26 is in effect a light optics device which contains light emitting means 32 hidden from direct view and that the light rays emitted therefrom are diffused by the frosted surfaces and viewed as a beautiful eye-appealing solid field or volume of luminous light, rather than a random flickering light sensation which is characteristic of physchedelics.

The light panel can be used as a wall or ceiling light or as a lighted tabletop or floor piece and the like. A preferred form is as an illuminated electric guitar 22′, see FIGS. 5 and 6, with the usual neck, strings, bridge section, fret board, etc. However, the guitar has a configured body 26′ of transparent plastic material, with a substantially trapezoidal cross-section at its greatest width, as shown in FIG. 7, similar to the body 26 of the light panel 22. The body 26′ varies in thickness from relatively thin frosted side edges 28′ at its greatest width, to gradually thicker, with widening frosted peripheral sides collectively designated by numeral 28*n*, to thickest at the central portion 30′ (see FIG. 6). The plastic material of the central portion contains a row of lamps or light bulbs 32′ encased in casings in three different colors, 34*a′* red, 34*b′* blue 34*c′* green. The casings are fitted within a row of perforations 36′ in the portion 30′, each perforation having a frosted cylindrical wall 38′ serving the same purpose as frosted wall 38 in the light panel body 26. Each light bulb 32′ is similar to light bulb 32 and has a central electrode and jacket electrode.

The plastic material guitar body 26′ has a water clear front viewing face surface 44′ and a backing including light diffusing frosted surfaces 46′, 48′ and 50′, and dark gray abrasive particle paper 52′ shaped to the surfaces 46′, 48′ and 50′, and disposed with the particle side thereof adjacent these frosted surfaces, these surfaces and paper serving the same purpose as in the light panel 22. There is also a back cover 64′, shaped to the frosted surfaces 46′, 48′ and 50′, and insulation as necessary or desired. A masking strip 68′, with a bright reflective underside 70′ is disposed atop the casings 34*a′*, 34*b′* and 34*c′* for the same purpose as the masking strip 68 and reflector 70 of the light panel 22.

A printed circuit board 54′, schematically illustrated in FIG. 8, is adapted to engage the electrodes of the light bulbs 32′, and after the manner of circuit board 54, has runs 56′, 58′ 60′ and 62′, and contacts 56*c′*, 58c', 60c' and 62c', engageable with the central electrodes and jacket electrodes of the light bulbs in the casings 34a' (red), 34b' (blue) and 34c' (green), respectively. The board 54' also has a pair of runs 72 and 74 which are insulated from each other and connected to a transducer 76 or other frequency responsive pickup means positioned on the guitar body 26', as shown in FIG. 5. Wires connected to the runs 56', 58', 60', 62', 72 and 74 are brought together and forms a harness or cable 78 connected to a frequency responsive electronic switching means 24' schematically illustrated in FIG. 9.

The frequency responsive pickup means 76 is activated by the playing of the guitar 22', and generates tone frequency signals which are connected through an adjustable gain control 80 and supplied as inputs to three adjustable frequency discriminator circuits 82, 84 and 86. Frequency discriminator 82 provides an output when the input frequencies are in a low range channel; frequency discriminator 86 provides an output when the input frequencies are in a high range channel; and frequency discriminator 84 when the input frequencies are in an intermediate range channel. Each frequency discriminator is adjustable so that the band of frequencies passed by one channel can be adjusted to include some or to exclude all of the frequencies passed by an adjacent channel. The outputs of the frequency discriminators 82, 84 and 86 are connected to wave shaper and voltage leveler circuits 88, 90 and 92, respectively.

The output of the circuit 88 is applied to an adjustable load resistor 94 and part of the voltage drop across the resistor is applied to an SCR 96. The outputs of the circuits 90 and 92 are respectively applied to adjustable load resistors 98 and 100 and SCRs 102 and 104. SCR 96 is connected in series with each of the light bulbs in the red casings 34a' (only one of which is shown) in the guitar body 26' (fragmentarily shown). SCR 102 is series connected with each of the bulbs in the blue casings 34b', and SCR 104 is in series with each of the bulbs in the green casings 34c'.

Power for the switching means 24' is obtained from an alternating current (AC) source which is connected through a switch 106 to AC power supply 108 for application to the SCRs 96, 102, 104 and to the light bulbs in the casings 34a', 34b' and 34c'. AC power is also applied to a DC power supply 110, the output of which is applied to the frequency discriminators 82, 84 and 86.

It is believed that the operation of the guitar 22' and switching means 24' is readily apparent and is briefly summarized at this point. With switch 106 closed, power is applied and as the guitar is played the pickup 76 generates tone frequency signals which are fed to the frequency discriminators 82, 84 and 86. Depending upon the range of the tone frequencies generated, one or more of the frequency discriminators can be caused to provide an output to one or more of the associated circuits 88, 90 and 92. When the circuit 82 provides an output it is applied to the associated circuit 88 which in turn provides an output that places the associated SCR 96 into conductive mode, or "turns it on," and the light bulbs in red casings 34a' are energized. With such energization, the frosted surfaces 28', 28n, 46', 48' and 50' diffuse the red color light and glow to provide a solid field of steady red color. When there is an output from circuit 84 the color field is blue, and an output from circuit 86 provides a green color field. However, when there are outputs simultaneously from the circuits 82 and 84, the color field is the sum of the basic red and blue colors; and when there are simultaneous outputs from the circuits 84 and 86 the color field is the sum color of the basic blue and green colors. Another sum color is produced when there are outputs from circuits 86 and 82, and still another when outputs from all three circuits 82, 84 and 86 are present. Also, with energization and de-energization of the light bulbs, there is a variety of color fields which change hue. This provides a spectacular light display with pleasant eye appeal to the audience and which is also pleasing to the musician who sees his music in color.

If desired, the frequency responsive switching means 24' of FIG. 9 can be adapted to energize the light bulbs 32 of the light panel 22.

Figure 10:
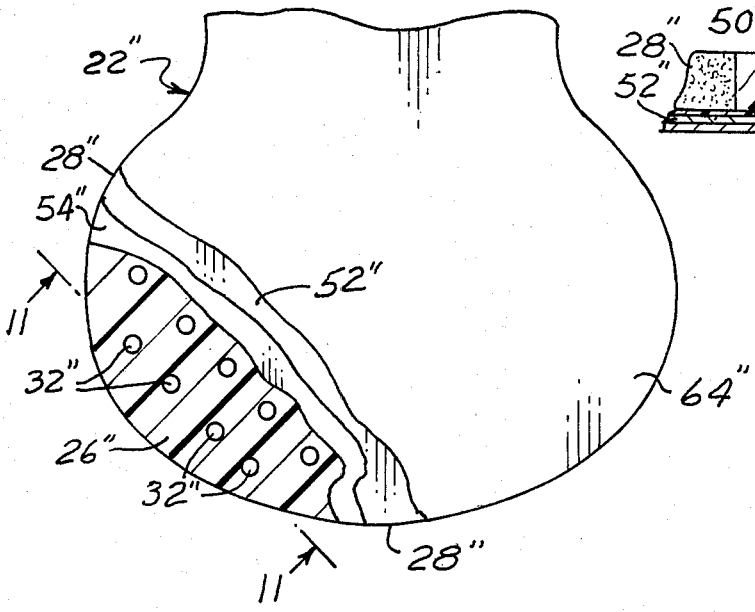
FIG. 10 is a fragmentary bottom plan view of an alternative form of a plastic guitar embodying the principles of the invention with parts broken away and partly in section.
Figure 11:
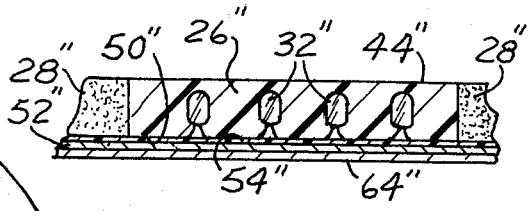
FIG. 11 is an inverted vertical sectional view generally along line 11—11 of FIG. 10.

FIG. 10 fragmentarily illustrates a modified form of plastic guitar 22'' which has a body 26'' of solid transparent plastic material with frosted side surfaces 28'', see FIG. 11, and a frosted bottom surface 50''. A top or front surface 44'' may be water clear or frosted, as desired. Miniature lamps 32'' of the type known as "grains of wheat" are embedded in the plastic material. The lamps are arranged in rows and columns in three basic colors —red, blue and green— with the lamps in one row being of the same color and the different color rows arranged serially. A light shield 52'', circuit board 54'' and protective cover 64'' can be provided adjacent the circuit board. The lamps can be energized by the frequency responsive switching means 24' of FIG. 9 or other suitable means.

Figure 13:
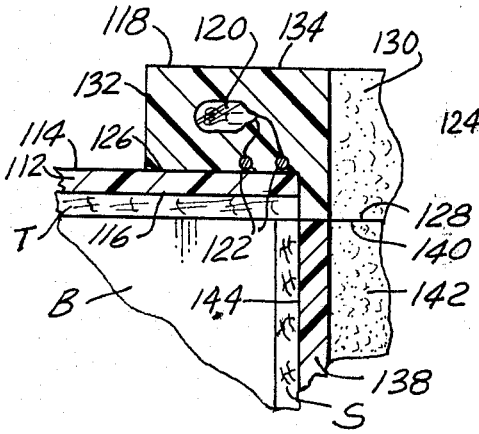
FIG. 13 is a larger scale fragmentary vertical sectional view generally along line 13—13 of FIG. 12.
Figure 12:
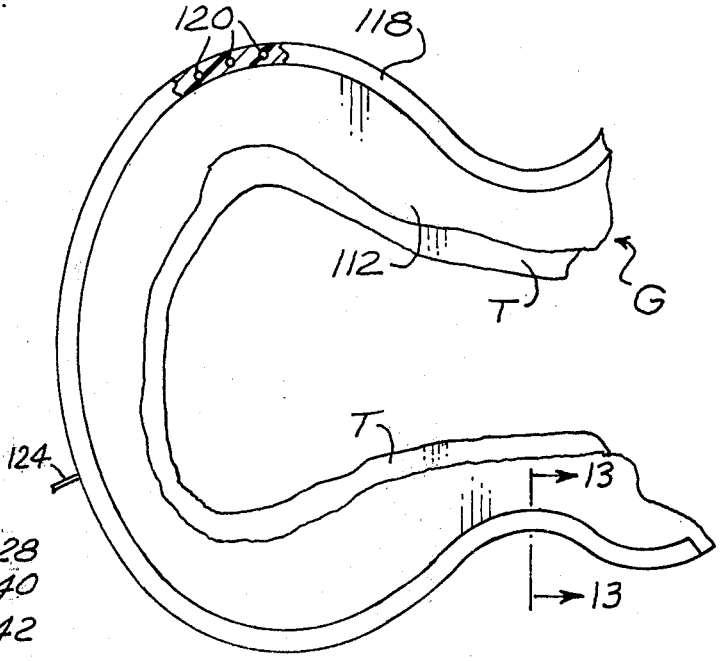
FIG. 12 is a fragmentary top plan view of a conventional guitar to which plastic material parts embodying the principles of the invention have been applied, the parts being broken away and partly in section.

The principles of the present invention are applicable to a conventional guitar G having a body B with a top wall T and side wall S; see FIGS. 12 and 13. Overlying the top wall T is a sheet of plastic 112 configured thereto and having upper and lower frosted surfaces 114 and 116, respectively. A configured lighting strip 118 extends around most of the exterior edges of the plastic sheet and has embedded within it a series of closely spaced varicolored miniature lamps 120 (grain of wheat or the like) arranged the length of the strip. Preferably, there are three color sets of lamps, the lamps of each color being connected in parallel to suitable conductors 122, two of which are shown, the conductors being brought together to form a cable 124 for connection to suitable switching means. The lighting strip has frosted undersurfaces 126 and 128 and frosted side surfaces 130 and 132. The top surface 134 can be water clear or frosted, as desired. Adjacent the side wall S of the guitar G is a configured plastic strip 138 which has a top frosted surface 140 in contact the frosted surface 128 of the strip 118. The strip 138 also has a frosted exterior surface 142 and an interior frosted surface 144.

Figure 14:
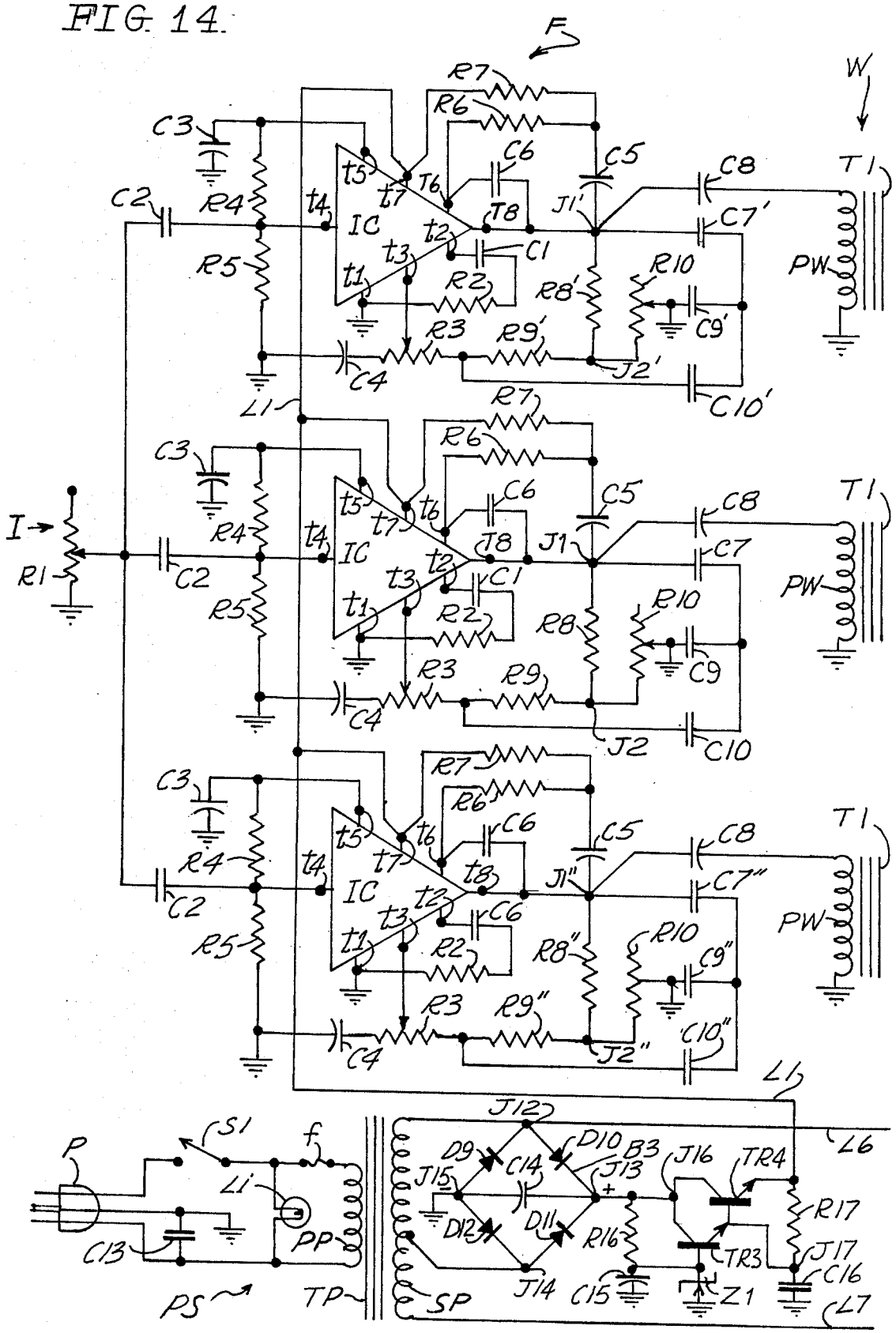
FIGS. 14 and **14*a*** schematically illustrate the circuitry of an alternate form of frequency responsive electronic switching means.
Figure 14A:
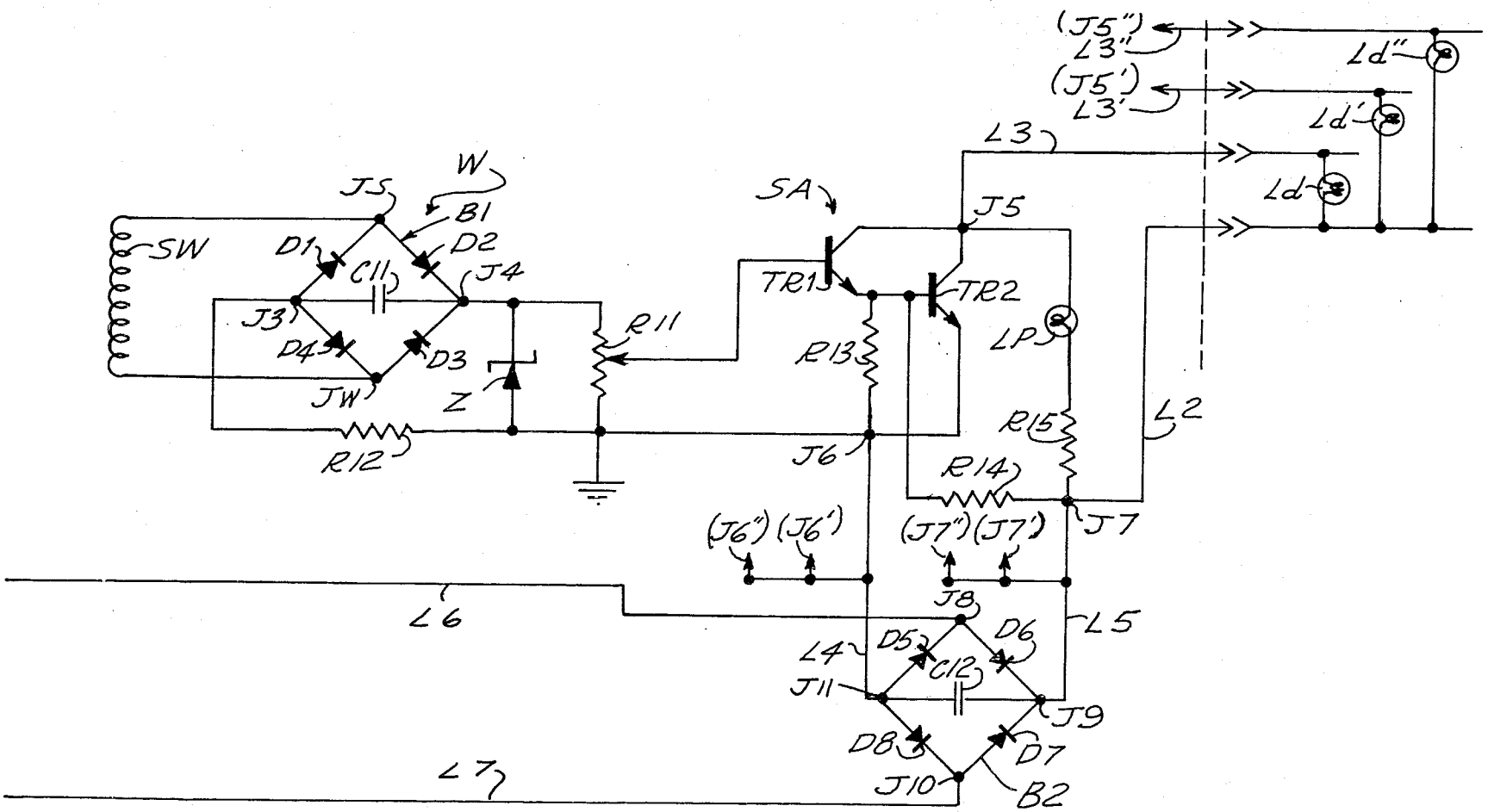

An alternative form of frequency responsive electronic switching means is schematically illustrated in FIGS. 14 and 14a and includes a plurality of band pass channels including frequency discriminators F with each of which is associated a wave form shaping and voltage leveler means W and a switching amplifier means SA, the frequency discriminators being tuned to pass different frequencies so as to cover a broad range of frequencies. Signal input means I feed frequency signals to the frequency discriminators and a power supply PS provides necessary power. Only one channel will be described, it being understood that the description applies to corresponding components or elements in the other channels which are referred to by characters that are alike or primed or double-primed.

The signal output means has an adjustable gain control or potentiometer R1. The frequency discriminator means F includes solid state linear integrated circuitry IC, such as a Motorola IC C-6004 or the like, which has terminals *t*1, *t*2, *t*3, *t*4, *t*5, *t*6, *t*7 and *t*8. Terminal *t*1 is grounded and it is connected to terminal *t*2 through an RC network consisting of a resistor R2 and a capacitor C1. Terminal *t*3 is connected to a potentiometer R3. Terminal *t*4 is connected to a junction of resistors R4 and R5 and to the signal input gain control R1 through a coupling capacitor C2. The other end of the resistor R4 is connected to terminal *t*5 and to a grounded decoupling capacitor C3. The other end of resistor R5 is connected to ground and to one side of a direct current blocking capacitor C4, the other side of which is connected to one end of the potentiometer R3. Terminal *t*6 is connected to one end of a resistor R6, the other end of which is connected to one side of a signal damping capacitor C5 and one end of a resistor R7, the other end of which is connected to terminal *t*7. Terminal *t*7 is connected by a power lead L1 to the power supply PS for receiving direct current power therefrom. The other side of the capacitor C5 is connected to a junction J1 (J1′ and J1″ in the other channels) and to terminal *t*8 which terminal is interconnected with terminal *t*6 through a signal damping capacitor C6. Connected to the junction J1 is one end of a resistor R8 (R8′ and R8″ in the other channels) and one side, respectively of capacitors C7 (C7′ and C7″ in the other channels) and C8. The other side of capacitor C7 is connected to one side, respectively, of capacitors C9 (C9′ and C9″ in the other channels) and C10 (C10′ and C10″ in the other channels). The other side of capacitor C10 is connected to the other side of the potentiometer R3, and to one end of a resistor R9 (R9′ and R9″ in the other channels), the other end of which is joined at a junction J2 (J2′ and J2″ in the other channels) to the other end of the resistor R8. Connected to the junction J2 is a potentiometer R10 which is connected to ground and to the other side of the capacitor C9. The other side of the capacitor C8 is connected to a transformer T1 via its primary winding PW, the transformer being part of the wave form shaper and voltage leveler circuit W which is associated with the frequency discriminator means F.

Resistors R6 and R7 form a direct current power distribution network of the power received at terminal *t*7. Resistors R4 and R5 form a direct current power biasing network which receives power via an internal connection between terminals *t*5 and *t*7. The R2-C1 network is connected internally to the transistor drive circuit of the IC and provides for linear amplifier operation.

Resistors R8 (R8′, R8″), R9 (R9′, R9″), R10 (R10′, R10″) and capacitors C7 (C7′, C7″), C9 (C9′, C9″), C10 (C10′, C10″), form an RC bridge network tunable to resonate at the desired channel frequency response of the channel. When the desired frequency signals are present at terminal *t*4, the RC bridge network will resonate and generate a negative feedback which is applied to terminal *t*3 through the potentiometer R3, causing the integrated circuitry IC to operate as a non-linear amplifier, the potentiometer serving as a gain control therefor. Non-linear operation creates a block of wave forms of large signal amplitude at terminal *t*8 which are coupled to the primary winding of the transformer T through the capacitor C8. The values of the components in the RC bridges in the frequency discriminators are varied to obtain different frequency band channel response therein.

As shown in FIG. 14*a*, each transformer T1 has a secondary winding SW which is connected to a rectifier bridge B1 having junctions J3, Js, J4, Jw, diodes D1, D2, D3 and D4 and a filtering capacitor C11 interconnecting the junctions J3 and J4. Junction J4 is connected to the positive side of a zener diode Z and one end of a potentiometer R11. Junction J3 is connected to one end of a current limiting resistor R12, the other end of which is connected to the negative side of the zener diode and to the other end of the potentiometer R11 which is grounded. The wave forms coupled to the primary winding of the transformer T11 are irregular but in passing through the primary winding are shaped into sine waves that are transferred to the secondary winding. The output of the secondary winding is fed into the rectifier bridge which provides a direct current voltage that is applied to the zener diode, the zener diode limiting the voltage that is applied to the potentiometer R11.

The switching amplifier SA includes transistors TR1 and TR2, the potentiometer R11 being connected to the base of the transistor TR1. The collectors of these transistors are joined at a junction J5 (J5′ and J5″ in the other channels) and the emitter of transistor TR1 is interconnected with the base of the transistor TR2, which interconnection is connected to the grounded end of the potentiometer R11 through a resistor R13 and a junction J6 (J6′ and J6″ in the other channels). The emitter of the transistor TR2 is connected to the grounded junction J6. Also connected to said interconnection is one end of a resistor R14, the other end of which is connected to a junction J7 (J7′ and J7″ in the other channels) from which extends a load lead L2. A resistor R15 and a panel indicator light LP are series connected across the junctions J7 and J5, a load lead L3 extending from the latter. A load Ld such as a light, heater, indicator, and the like, is adapted to be connected across the leads L2 and L3. (Associated with the junctions J5′ and J5″ are loads Ld′ and Ld″ which are adapted to be connected across leads L2 and L3′ and L3″, respectively).

Junction J6 (J6′, J6″) and the grounded emitter of the transistor TR2 receive negative direct current power from the power supply PS by way of a power lead L4, the junction J7 (J7′, J7″) receiving positive direct current power via power lead L5. The power supply includes a rectifier bridge B2 which has diodes D5, D6, D7, D8 and a filter capacitor C12, and junctions J8, J9, J10 and J11, the leads L4 and L5 being connected to the junctions J11 and J9, respectively. The potentiometer R11 is adjustable to set the sensitivity of the transistor TR1 and when there is an output from the rectifier bridge B1, the transistor TR1 is "turned on" and it causes the transistor TR2 to go into conducting mode and a direct current path is provided through the load Ld and the light LP. Junctions J8 and J10 have cinnected thereto leads L6 and L7, respectively.

Turning to FIG. 14, leads L6 and L7 are connected to the respective ends of a secondary winding SP of a power transformer TP which has a primary winding PP. One end of the primary winding is connected to one prong of a three-pronged plug P through a fuse f and a switchh S1, the other end of the primary winding being connected to another prong of the plug and to a grounded capacitor C13. The third prong is grounded. An indicator light Li is provided to indicate when the power is on.

The power supply PS also includes a rectifier bridge B3 which has diodes D9, D10, D11, D12 and a filter capacitor C14, and junctions J12, J13, J14, J15. Junction 12 is connected to lead L6, and junction 14 is connected to a center tap on the power transformer secondary winding SP. Junction J15 is grounded and capacitor C14 interconnects junctions J15 and J13. Junction J13 is connected to one end of a resistor R16. The other end of the resistor is connected to a bypass filter capacitor C15 and to a junction between the positive side of a zener diode Z1 and the base of a transistor TR3. The zener diode has its negative side grounded and fixes the stability of the base current of the transistor through the resistor. The collector of the transistor TR3 is connected to the collector of a transistor TR4 at a junction J16 which is also connected to the junction J13. The emitter of the transistor TR3 is connected to the base of the transistor TR4 and to a junction J17 of a bypass filter capacitor C16 and one end of a voltage sensing feedback resistor R17. The other end of the resistor R17 is connected to the emitter of the transistor TR4 and the power lead L1. This arrangement provides an emitter follower power regulator which delivers positive direct current to the frequency discriminators.

It is believed that the operation of the frequency responsive switching means of FIGS. 14 and 14*a* is readily apparent and is briefly summarized at this point. With switch S1 closed, power is delivered to the frequency discriminators F, and the switching amplifiers SA associated therewith. Frequency signals from the input I are fed to the frequency discriminators which sample the signals and each passes the frequency to which its RC bridge network is tuned, causing the network to resonate and provide an output which is coupled through its coupling capacitor C8 to the associated wave form shaping and voltage leveler circuit W, which in turn provides an output causing its transistor TR2 to conduct and energize the load and panel light across leads L2 and L3 (L3′, l3″).

It is understood, of course, that the number of bandpass channels can be varied to cover additional frequencies and broader ranges of frequencies, and that energization of the loads can serve to indicate the presence of the frequencies that are passed by the channels.

There has thus been provided a lighting effects device which includes colored lights set in plastic and provides color fields of solid volumes of luminous light in the basic, pastel and sum colors thereof, the color fields changing hue with variations in the energization of the colored lights, the lighting effects device being incorporated in a plastic guitar body and energization of the colored lights in the guitar being responsive to tone frequencies as the guitar is played, for a spectacular eye-appealing display of changing color.

Although the present invention has been described in considerable detail, it will be understood by those skilled in the art that the invention is not limited by such details but may take various other forms within the scope of the appended claims.

What is claimed and desired to be protected by Letters Patent of the United States is:

1. A lighting effects device comprising:

a piece of solid transparent plastic material, a plurality of differently colored light emitting means positioned within said plastic material, said plastic material having a frosted rear surface for diffusing light from the light emitting means and glowing as a solid field of luminous light and a clear front surface providing an unobstructed view of the glowing frosted surface; and means for variously energizing the light emitting means in one color and in a combination of colors for causing the frosted surface to glow and provide a field of light which changes hue with variations in the energization of the light emitting means.

2. The device of claim 1 further including means masking the light emitting means for hiding them from view.

3. The device of claim 1 further including a piece of abrasive particle material adjacent the frosted surface for enhancing light diffusion.

4. The device of claim 1 wherein said plastic material piece is elongated and the light emitting means includes a longitudinal row of light bulbs therein, and further including a relatively narrow masking strip on said clear front face over the light bulbs for hiding them from view.

5. The device of claim 4 wherein the masking strip has a reflective undersurface facing the light bulbs.

6. The device of claim 1 wherein said plastic material piece is elongated and has a substantially trapezoidal cross sectional shape with frosted back surfaces acutely angled relative to the clear front face, said light emitting means is a row of lights in the central portion of the piece, and further including a relatively narrow masking strip over the row of lights for hiding them from view.

7. The device of claim 6 wherein said plastic material piece has a row of perforations in the central portion thereof, and each light is a light bulb in each of the perforations.

8. The device of claim 7 wherein each perforation has a light diffusing frosted surface side wall for further hiding the light bulb from view.

9. The device of claim 1 wherein said plastic material piece is configured to the shape of a guitar body and has frosted back and side surfaces angled relative to the front face, said light emitting means is a longitudinal row of light bulbs positioned centrally in the plastic material, energization of the light bulbs causing the frosted surfaces to glow for viewing from the front and sides, and a masking strip over the light bulbs for hiding them from view.

10. The device of claim 9 wherein the light bulbs are serially arranged in sets of three basic colors, red, blue and green, energization of the light bulbs providing fields of colored light in each of the basic colors and the sum colors thereof.

* * * * *